US005796647A

United States Patent [19]

Iizuka et al.

[11] Patent Number: 5,796,647

[45] Date of Patent: Aug. 18, 1998

[54] INNER PRODUCT CALCULATION DEVICE

[75] Inventors: Kunihiko Iizuka, Sakai; Mitsuhiko Fujio, Ikoma; Hirofumi Matsui, Ikoma-gun; Masayuki Miyamoto, Nabari, all of Japan

[73] Assignee: Sharp Kabushiki Kaisha, Osaka, Japan

[21] Appl. No.: 599,746

[22] Filed: Feb. 12, 1996

[30] Foreign Application Priority Data

Feb. 14, 1995 [JP] Japan ..... 7-025537

[51] Int. Cl.[6] ..... G06G 7/00

[52] U.S. Cl. ..... 364/807

[58] Field of Search ..... 364/807, 825, 364/607

[56] References Cited

U.S. PATENT DOCUMENTS 5,168,461 12/1992 Wu et al. ..... 364/825
5,325,322 6/1994 Bailey et al. ..... 364/825

FOREIGN PATENT DOCUMENTS

A-0 071 528 2/1983 European Pat. Off. .
6-215164 8/1994 Japan .

OTHER PUBLICATIONS

*International Journal of Electronics*, vol. 64, No. 3, Mar. 1988, pp. 359–375, Cichoki A. et al., "Switched–Capacitor Function Generators".

IEEE International Symposium on Circuits and Systems Proceedings, vol. 3 of 3, Apr. 27, 1981, Chicago; pp. 733–736, Gregorian et al., "An Integrated single–chip, switched–capacitor speech synthesizer".

Gregorian et al., Analog MOS integrated circuits for signal processing;, 1986, Wiley & Sons, New York, pp. 412–416.

*Primary Examiner*—Tan V. Mai

*Attorney, Agent, or Firm*—David G. Conlin; Brian L. Michaelis

[57] ABSTRACT

An inner product calculation device for calculating an inner product of a coefficient vector including at least one first element with a positive sign and at least one second element with a negative sign and an input vector including elements corresponding to a plurality of input voltages. The device includes: an amplifier having an input terminal and an output terminal; a first capacitor corresponding to the first element and having a capacitance in proportion to a value of the first element; a second capacitor corresponding to the second element, and having a capacitance in proportion to an absolute value of the second element; a third capacitor connected to one end of the first capacitor, one end of the second capacitor, and the input terminal of the amplifier; a voltage source applying, during a first period a corresponding one of the input voltages to the first capacitor and a reference voltage to the second capacitor and the third capacitor; and applying, during a second period following the first period, the reference voltage to the first capacitor, a corresponding one of the plurality of input voltages to the second capacitor, and an output voltage output from the output terminal of the amplifier to the third capacitor; and a switch for short-circuiting the input terminal of the amplifier and the output terminal of the amplifier during a third period.

6 Claims, 6 Drawing Sheets

INNER PRODUCT CALCULATION DEVICE

BACKGROUND OF THE INVENTION

1. Field of the Invention

The present invention relates to an inner product calculation device for calculating an inner product of an n-dimension coefficient vector and an n-dimension input vector having a plurality of analog voltage values as elements thereof by employing an analog circuit incorporating switched capacitors (where n is a positive integer). The inner product calculation device can be suitably used for image compression techniques and the like.

2. Description of the Related Art

A circuit shown in the literature by Roubik Gregorian and Gabor C. Temes entitled "Analog MOS Integrated Circuits for Signal Processing", 1986, John Wily & Sons, pp. 413, FIG. 6.3, is an example of a conventionally known circuit for calculating an inner product of an input vector of n dimensions having a plurality of analog voltage values as elements thereof and a coefficient vector of n dimensions by employing an analog circuit incorporating switched capacitors. This circuit is described with reference to FIG. 6 below.

FIG. 6 is a circuit diagram showing the above-mentioned conventional inner product calculation device incorporating switched capacitors and an operational amplifier 11.

As shown in FIG. 6, the non-inversion input terminal of the operation amplifier 11 is grounded. The capacitors $\alpha C_0$ and $C_0$ and switches S1 and S2 constitute a feedback selection circuit for the operational amplifier 11.

Input voltages $V_1$ to $V_n$ and an output voltage $V_0$ satisfy the relationship expressed by eq. 1.

$$V_o = -\sum_{i=1}^{n} \frac{C_i}{C_f} V_i \qquad \text{eq. 1}$$

The output voltage $V_0$ represents an inner product of a coefficient vector $[-C_1/C_0, -C_2/C_0, \ldots, -C_n/C_0]$ and an input voltage vector $[V_1, V_2, \ldots, V_n]^T$.

The operational amplifier 11 shown in FIG. 6 is capable of calculating the inner product of the above vectors in the case where all the elements of the coefficient vector have negative values, by taking the ratio of capacitance $C_j$ to capacitance $C_0$ (i.e., $-C_j/C_0$, where j is an integer in the range of 1 to n inclusive), to be the absolute value of each element of the coefficient vector. Herein, capacitance $C_j$ and capacitance $C_0$ always take a positive value. Therefore, the operational amplifier 11 shown in FIG. 6 cannot calculate an inner product of an input voltage vector and a coefficient vector whose elements all take positive values. Needless to say, the operational amplifier 11 shown in FIG. 6 cannot calculate an inner product of an input voltage vector and a coefficient vector some of whose elements take positive values and others take negative values.

An input offset Voffset of the operational amplifier 11 shown in FIG. 6 and the output voltage $V_0$ given by eq. 1 satisfy eq. 2 shown below:

$$V_o - V_{ref} = -\frac{\sum_{i=1}^{m} C_i(V_i - V_{ref})}{C_o} + V_{offset} \qquad \text{eq. 2}$$

However, since eq. 2 includes an offset voltage (i.e., Voffset), the result of the inner product calculation includes some error due to the offset voltage.

SUMMARY OF THE INVENTION

An inner product calculation device for calculating an inner product of a coefficient vector including at least one first element with a positive sign and at least one second element with a negative sign and an input vector including elements corresponding to a plurality of input voltages according to the present invention includes: an amplifier having an input terminal and an output terminal; at least one first capacitor corresponding to the at least one first element with the positive sign, the first capacitor including one end, another end, and a capacitance which is in proportion to a value of the at least one first element; at least one second capacitor corresponding to the at least one second element with the negative sign, the second capacitor including one end, another end, and a capacitance which is in proportion to an absolute value of the second element; a third capacitor having one end and another end, the one end being connected to the one end of the first capacitor, the one end of the second capacitor, and the input terminal of the amplifier; a voltage source for: (a) applying, during a first period, a corresponding one of the plurality of input voltages to the other end of each of the at least one first capacitor and a reference voltage to the other end of the at least one second capacitor and the other end of the third capacitor; and (b) applying, during a second period following the first period, the reference voltage to the other end of the first capacitor, a corresponding one of the plurality of input voltages to the other end of each of the at least one second capacitor, and an output voltage output from the output terminal of the amplifier to the other end of the third capacitor; and a switch for short-circuiting the input terminal of the amplifier and the output terminal of the amplifier during a third period.

In one embodiment of the invention, each of the at least one first capacitor receives a binary signal for changing the capacitance of the first capacitor, and each of the at least one second capacitor receives a binary signal for changing the capacitance of the second capacitor.

In another embodiment of the invention, the first period is longer than the third period.

In still another embodiment of the invention, the amplifier is an operational amplifier.

In still another embodiment of the invention, the amplifier includes at least one invertor.

In still another embodiment of the invention, the plurality of input voltages consist of a set consisting of those input voltages which correspond to the other end of the at least one first capacitor and a set consisting of those input voltages which correspond to the other end of the at least one second capacitor.

In accordance with the inner product calculation device of the present invention, an inner product of an n-dimension coefficient vector consisting of n elements with signs of plus or minus and an n-dimension input vector whose elements are n voltage values (where n is a positive integer) is calculated by means of a circuit including switched capacitors and an operational amplifier.

In accordance with the inner product calculation device of the present invention, the input offset voltage of the operational amplifier can be cancelled, so that there is no need to further incorporate a circuit for cancelling the input offset voltage in the inner product calculation device. As a result, an accurate calculation is performed without increasing the scale of the inner product calculation device.

Thus, the invention described herein makes possible the advantages of: (1) providing an inner product calculation device capable of calculating an inner product of a coefficient vector and an input voltage vector even in the case where the coefficient vector includes both positive elements and negative elements, without employing complicated circuitry or increasing the circuit scale and power consumption: and (2) providing an inner product calculation device capable of cancelling the input offset of an operational amplifier, thereby eliminating errors due to the input offset voltage in the inner product calculation.

These and other advantages of the present invention will become apparent to those skilled in the art upon reading and understanding the following detailed description with reference to the accompanying figures.

DESCRIPTION OF THE PREFERRED EMBODIMENTS

EXAMPLE 1

Hereinafter, an inner product calculation device according to Example 1 of the present invention will be described with reference to FIG. 1.

In the present example, an inner product of a fixed coefficient vector and an input voltage vector is calculated. Each element of the coefficient vector can be an analog value.

Figure 1:
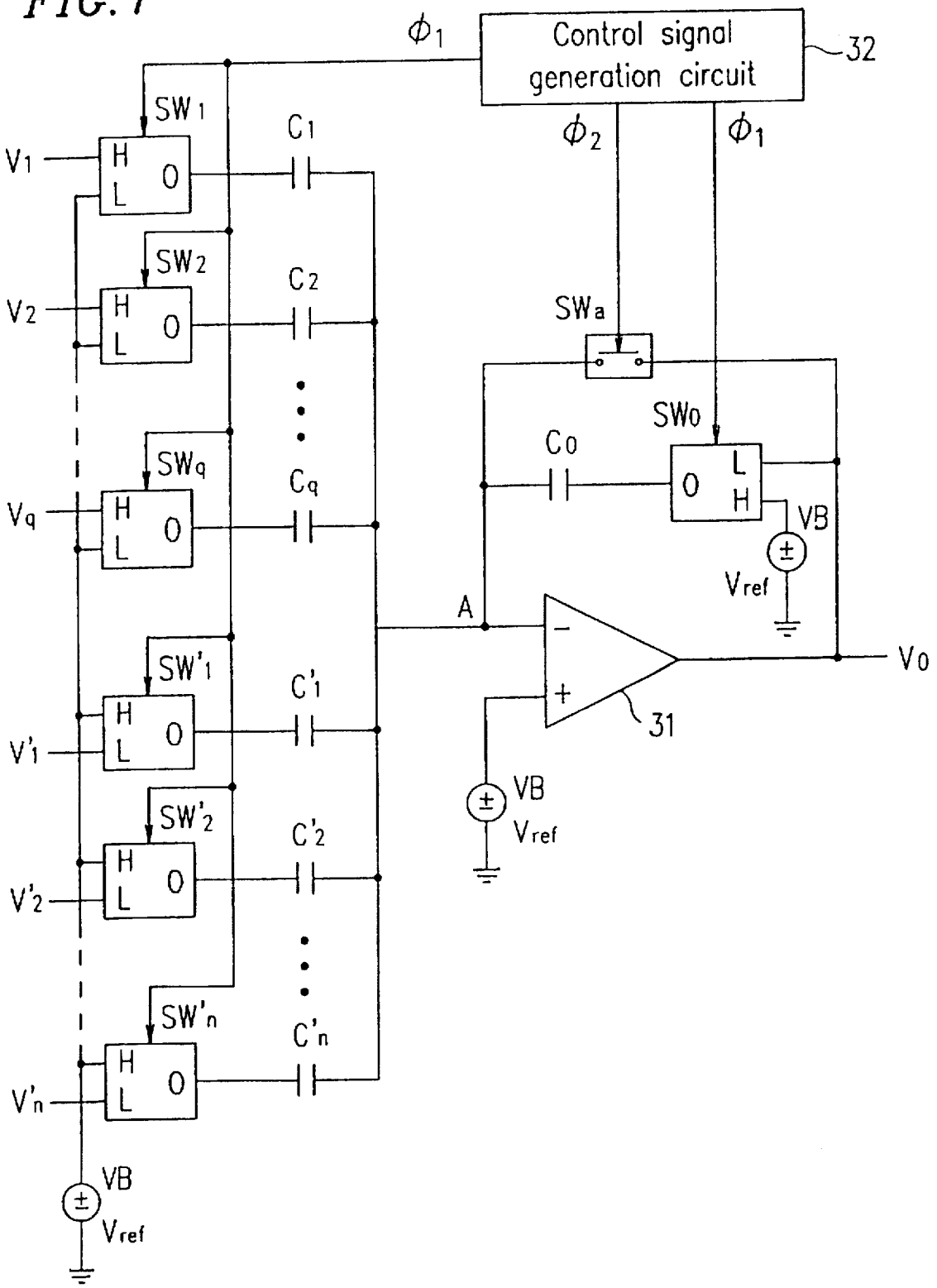
FIG. 1 is a circuit diagram showing an inner product calculation device according to Example 1 of the present invention.

The inner product calculation device shown in FIG. 1 includes switches $SW_0$ to $SW_q$, switches $SW'_1$ to $SW'_n$, a switch SW*a*, capacitors $C_1$ to $C_q$, capacitors $C'_1$ to $C'_n$, three reference voltage sources VB, an operational amplifier 31, and a control signal generation circuit 32 (where n and q are positive integers). The operational amplifier 31 can be an invertor. It is applicable to incorporate only one voltage source which is capable of applying the same reference voltage Vref to predetermined terminals.

Each of the switches $SW_0$ to $SW_q$ and each of the switches $SW'_1$ to $SW'_n$ includes terminals H and L and a common terminal O. Either one of the terminals H and L is electrically connected to the common terminal ), in accordance with a control signal $\phi 1$. The terminal H is connected to the common terminal O when the control signal $\phi 1$ is at a high level; the terminal L is connected to the common terminal O when the control signal $\phi 1$ is at a low level.

The switch SW*a* includes two terminals, which are controlled in accordance with the control signal $\phi 2$. The two terminals of the switch SW*a* are electrically connected to each other when the control signal $\phi 2$ is at a high level; the two terminals of the switch SW*a* are not electrically connected to each other when the control signal $\phi 2$ is at a low level.

A feedback selection circuit for the operational amplifier 31 is constituted by a serial circuit including the switch $SW_0$ and the capacitor $C_0$ and the switch SW*a*. The switch SW*a* is connected in parallel with the switch $SW_0$ and the capacitor $C_0$. A non-inversion input terminal of the operational amplifier 31 is connected to the reference voltage source VB having a reference voltage Vref.

The operational amplifier 31 takes either a follower coupling state and an inversion amplification coupling state in accordance with the state of the control signal $\phi 2$.

When the control signal $\phi 2$ is at the high level, the switch SW*a* is set so that the operational amplifier 31 enters a follower coupling state. When the control signals $\phi 1$ and $\phi 2$ are at the low level, the switches $SW_0$ and SWa are set so that the operational amplifier 31 enters an inversion amplification coupling state.

The terminal L of the switch $SW_0$ is connected to an output terminal of the operational amplifier 31. The terminal H of the switch $SW_0$ is connected to the reference voltage source VB.

The switches $SW_1$ to $SW_q$ are connected in series to the capacitors $C_1$ to $C_q$, respectively. The switches $SW'_1$ to $SW'_n$ are connected in series to the capacitors $C'_1$ to $C'_n$, respectively.

Connected to an inversion input terminal of the operational amplifier 31 and the feedback selection circuit via a junction A are: a serial circuit including the switch $SW_1$ and the capacitor $C_1$, a serial circuit including the switch $SW_2$ and the capacitor $C_2$, . . . , a serial circuit including the switch $SW_{q-1}$ and the capacitor $C_{q-1}$, and a serial circuit including the switch $SW_q$ and the capacitor $C_q$, and a serial circuit including the switch $SW'_1$ and the capacitor $C'_1$, a serial circuit including the switch $SW'_2$ and the capacitor $C'_2$, . . . , a serial circuit including the switch $SW'_{n-1}$ and the capacitor $C'_{n-1}$, and a serial circuit including the switch $SW'_n$ and the capacitor $C'_n$. Thus, one end of the capacitors $C_1$ to $C_q$ each and one end of the capacitors $C'_1$ to $C'_n$ each are connected to the inversion input terminal of the operational amplifier 31, one end of the switch SW*a*, and one end of the capacitor $C_0$ via the junction A.

Voltages $V_1$ to $V_q$ are applied to the terminals H of the switches $SW_1$ to $SW_q$, respectively. The reference voltage Vref is applied to the terminals L of the switches $SW_1$ to $SW_q$. The reference voltage Vref is applied to the terminals H of the switches $SW'_1$ to $SW'_n$. Voltages $V'_1$ to $V'_n$ are applied to the terminals L of the switches $SW'_1$ to $SW'_n$, respectively.

The inner product calculation device of the present example calculates an inner product of the input voltages $V_1$ to $V_q$ and positive elements of the coefficient vector, and calculates an inner product of the input voltages $V'_1$ to $V'_n$ and negative elements of the coefficient vector. The positive elements can include zero; the negative elements can include zero.

The switches $SW_1$ to $SW_q$ selectively allow either the respective input voltages $V_1$ to $V_q$ or the reference voltage Vref to be applied to the capacitors $C_1$ to $C_q$ in accordance with the control signal $\phi 1$ output from the control signal generation circuit 32.

The switches $SW'_1$ to $SW'_n$ selectively allow either the respective input voltages $V'^1$ to $V'_n$ and the reference voltage Vref to be applied to the capacitors $C'_1$ to $C'_n$ in accordance with the control signal $\phi 1$ output from the control signal generation circuit 32.

The control signal generation circuit 32 is thus connected to the switches $SW_0$, $SW_1$, . . . , and $SW_q$, the switches $SW'_1$, $SW'_2, \ldots,$ and $SW'_n$, and the switch $SWa$. The control signal generation circuit 32 outputs the control signal $\phi 1$ to the switches $SW_0, SW_1, \ldots,$ and $SW_q$ and the switches $SW'_1, SW'_2, \ldots,$ and $SW'_n$, and outputs the control signal $\phi 2$ to the switch $SWa$.

When the operational amplifier 31 enters a follower coupling state, the input voltages $V_1$ to $V_q$ are applied to the capacitors $C_1$ to $C_q$. When the operational amplifier 31 enters an inversion amplification coupling state, the input voltages $V'_1$ to $V'_n$ are applied to the capacitors $C'_1$ to $C'_n$.

Hereinafter, the operation of the inner product calculation device of the present invention will be described in relation to the control signals $\phi 1$ and $\phi 2$.

Figure 7:
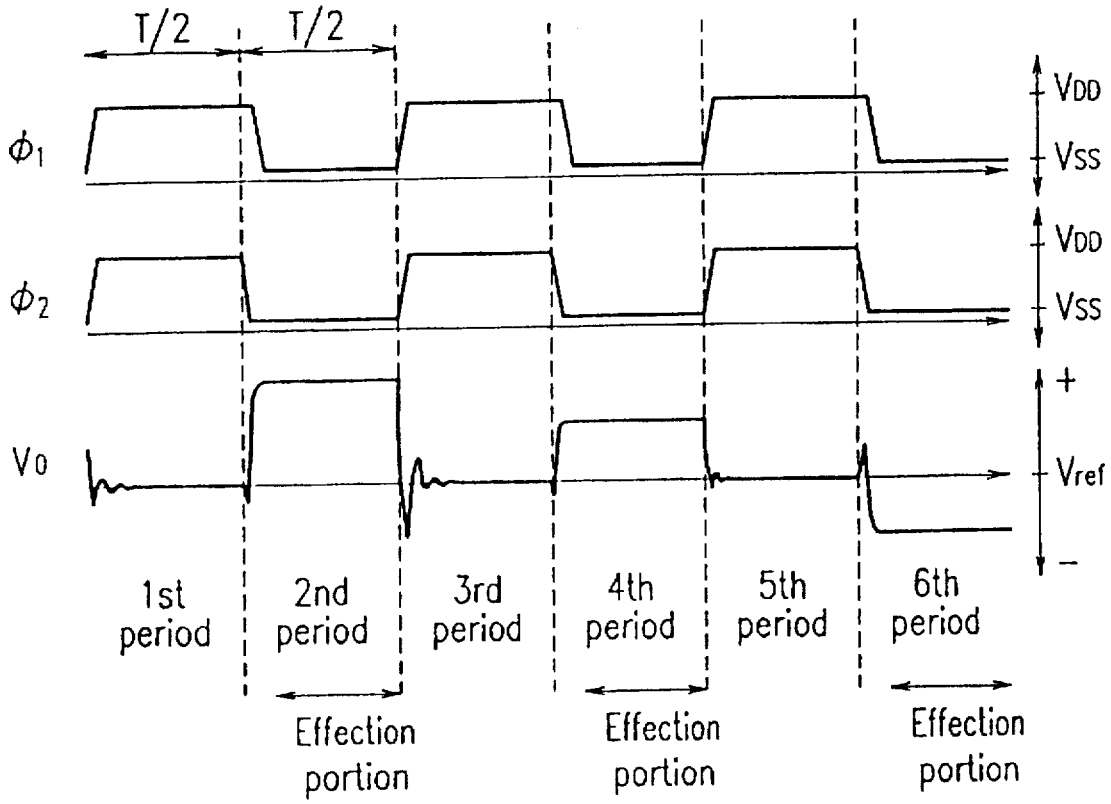
FIG. 7 is a waveform diagram showing the relationship between control signals $\phi 1$ and $\phi 2$ and an output signal $V_O$.

FIG. 7 shows the waveform of the control signal $\phi 1$ for controlling the switches $SW_0$ to $SW_q$ and the switches $SW'_1$ to $SW'_n$ and the waveform of the control signal $\phi 2$ for controlling the switch $SWa$.

In the 1st period, 3rd period, and 5th period (hereinafter collectively referred to as the "former periods"), the control signals $\phi 1$ and $\phi 2$ are both at the high level. In the 2nd period, 4th period, and 6th period (hereinafter collectively referred to as the "latter periods"), the control signal $\phi 2$ shifts to the low level before the control signal $\phi 1$ shifts to the low level. The output voltage ($V_0$—Vref) in effective portions of the latter periods is the inner product of $[-C_1/C_0, -C_2C_0, \ldots, -C_qC_0, C'_1/C_0, C'_2C_0, \ldots, C'_n/C_0]$ and the input vector $[V_1\text{—Vref}, V_2\text{—Vref}, \ldots, V_q\text{—Vref}, V'_1\text{—Vref}, V'_2\text{—Vref}, \ldots, V'_n\text{—Vref}]^T$.

When the control signal $\phi 2$ is at the high level, the operational amplifier 31 enters a follower coupling state. In this state, the reference voltage Vref is applied to the capacitor $C_0$; the input voltages $V_1$ to $V_q$ are applied to the capacitors $C_1$ to $C_q$, respectively; and the reference voltage Vref is applied to the capacitors $C'_1$ to $C'_n$.

Therefore, the total charge induced on the junction A side in FIG. 1 can be represented by eq. 3 below:

$$\sum_{j=1}^{m} C_j(V_{ref} + V_{offset} - V_j) + \sum_{j=1}^{n} C'_j(V_{offset}) + C_o(V_{offset}) \qquad \text{eq. 3}$$

Next, as the control signal $\phi 2$ shifts to the low level, the junction A becomes a floating node, so that the total of the charges is maintained at the same value as that represented by eq. 3.

Thereafter, as the control signals $\phi 1$ and $\phi 2$ shift to the low level, the operational amplifier 31 enters an inversion amplification state. In this state, the output voltage $V_0$ is applied to the capacitor $C_0$; the reference voltage Vref is applied to the capacitors $C_1$ to $C_q$; and the input voltages $V'_1$ to $V'_n$ are applied to the capacitors $C'_1$ to $C'_n$.

Therefore, the total charge induced on the junction A side in FIG. 1 can be represented by eq. 4 below:

$$\sum_{j=1}^{m} C_j(V_{offset}) + \sum_{j=1}^{n} C'_j(V_{ref} + V_{offset} - V'_j) + C_o(V_{ref} + V_{offset} - V_o) \qquad \text{eq. 4}$$

In accordance with the inner product calculation device of the present invention, the control signal $\phi l$ shifts to the low level after the control signal $\phi 2$ shifts to the low level. Therefore, the two terminals of the capacitor $C_0$ are never short-circuited. Therefore, the total charge induced on the junction A side in FIG. 1 in the former period is successfully retained in the latter period.

The charge amount represented by eq. 3 and the charge amount represented eq. 4 are equal. By resolving an equation eq. 3=eq. 4 with respect to $V_0$—Vref, the input offset voltage Voffset of the operational amplifier 31 is cancelled, whereby eq. 5 is derived:

$$V_o - V_{ref} = -\frac{\sum_{j=1}^{M} Cj(Vj - V_{ref}) - \sum_{j=1}^{n} C'j(V'j - V_{ref})}{C_o} \qquad \text{eq. 5}$$

Owing to the above-described operation, the inner product calculation device of the present invention is not under the influence of the input offset voltage Voffset, which would otherwise cause an error in the calculated inner product value.

Therefore, the voltage (output voltage $V_0$—reference voltage Vref) obtained during effective portions of each cycle converges at the inner product of $[-C_1/C_0, -C_2C_0, \ldots, -C_qC_0, C'_1C_0, \ldots, C'_nC_0]$ and the input vector $[V_1\text{—Vref}, V_2\text{—Vref}, \ldots, V_q\text{—Vref}, V'_1\text{—Vref}, V'_2\text{—Vref}, \ldots, V'_n\text{—Vref}]^T$.

EXAMPLE 2

Hereinafter, an inner product calculation device according to Example 2 of the present invention will be described with reference to FIGS. 2 to 5 and FIG. 7.

In the present example, an inner product of a variable coefficient vector having digital values and an input voltage vector is calculated. Constituent elements which also appear in FIG. 1 are indicated by the same reference numerals used therein, and the descriptions thereof are omitted.

The present example employs the same control signals $\phi 1$ and $\phi 2$ employed in Example 1 (shown in FIG. 7).

Figure 2:
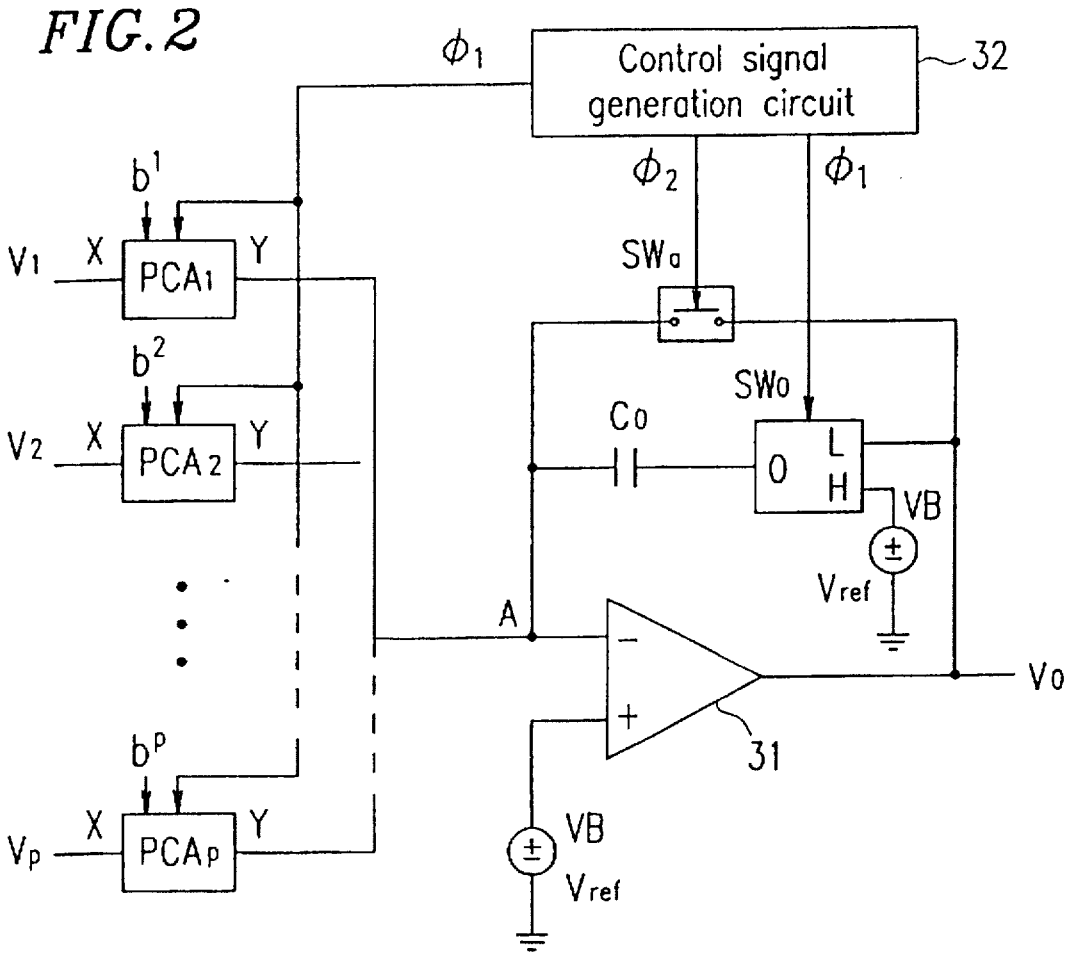
FIG. 2 is a circuit diagram showing an inner product calculation device according to Example 2 of the present invention.

The inner product calculation device shown in FIG. 2 incorporates an array of programmable capacitors $PCA_1$ to $PCA_p$ instead of the switches $SW_0$ to $SW_q$, the switches $SW'_1$ to $SW'_n$, the capacitors $C_1$ to $C_q$, and the capacitors $C'^1$ to $C'_n$ shown in FIG. 1. The programmable capacitors $PCA_1$ to $PCA_p$ (where p is a positive integer) are connected to an inversion input terminal of an operational amplifier 31. The programmable capacitors $PCA_1$ to $PCA_P$ receive digital signals $b_1$ to $b_p$, respectively, and the control signal $\phi 1$. The digital signals $b_1, b_2, \ldots,$ and $b_p$ are expressed by (n+1) bit digital values with signs of plus or minus.

Input voltages $V_1$ to $V_P$ are applied to input terminals X of the programmable capacitors $PCA_1$ to $PCA_P$, respectively.

Output terminals Y of the programmable capacitor array $PCA_1$ to $PCA_P$ are connected to the inversion input terminal of the operational amplifier 31 via a junction A.

A control signal generation circuit 32 is connected to the programmable capacitor array $PCA_1$ to $PCA_P$, and switches $SW_0$ and $SWa$. The control signal generation circuit 32 outputs the control signal $\phi 1$ to the programmable capacitor array $PCA_1$ to $PCA_P$ and the switch $SW_0$, and outputs the control signal $\phi 2$ to the switch $SWa$.

Figure 3:
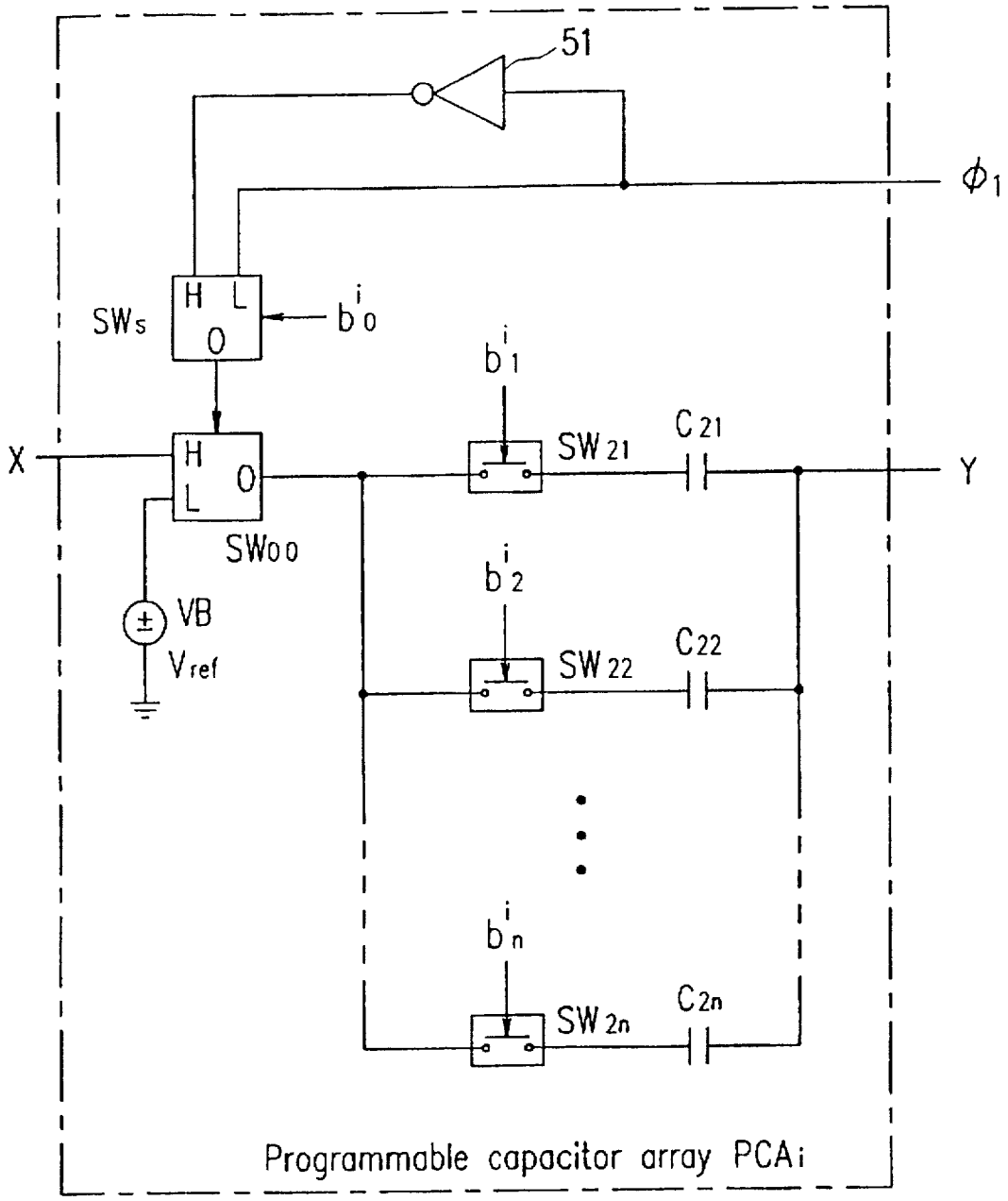
FIG. 3 is a circuit diagram showing an exemplary configuration for a programmable capacitor array $PCA_i$ in FIG. 2.

FIG. 3 is a circuit diagram showing an exemplary configuration for the programmable capacitor array $PCA_i$ shown in FIG. 2 (where i is an integer in the range of 1 to p inclusive).

The programmable capacitor array $PCA_i$ includes switches $SW_{00}$ and $SWs$ each having terminals H and L and a common terminal O; switches $SW_{21}$ to $SW_{2n}$ (where n is a positive integer); capacitors $C_{21}$ to $C_{2n}$, and an invertor 51.

The switches $SW_{00}$ and $SWs$ each include terminals H and L and a common terminal O. Either one of the terminals H and L is electrically connected to the common terminal O in accordance with the control signal $\phi 1$. The terminal H is connected to the common terminal O when the control signal $\phi 1$ is at a high level; the terminal L is connected to the common terminal O when the control signal $\phi 1$ is at a low level.

The switches $SW_{21}$ to $SW_{2n}$ each include two terminals, which are controlled in accordance with the control signal $\phi 2$. The two terminals are electrically connected to each other when the control signal $\phi 2$ is at a high level; the two terminals are not electrically connected to each other when the control signal $\phi 2$ is at a low level.

In FIG. 3, $b_0^i, b_1^i, \ldots, b_n^i$ are binary values which are binary expansion values of a (n+1) bit digital value with signs of plus or minus. These values are defined as in eq. 6 below:

$$b^i = (-1)^{b^i_0} \sum_{j=1}^{n} 2^{j-1} b_j^i \qquad \text{eq. 6}$$

The switches SWs, $SW_{21}$ to $SW_{2n}$ are controlled by the binary values $b_0^i, b_1^i, \ldots, b_n^i$, respectively. When the binary value $b_0^i$ is "0" (i.e., low level), the switch SWs selects the control signal $\phi 1$. When the binary value $b_0^i$ is "1" (i.e., high level), the switch SWs selects a signal obtained by inverting the control signal $\phi 1$ at an invertor 51. In other words, the binary value $b_0^i$ represents a sign (i.e., plus or minus).

These capacitors $C_{21}$ to $C_{2n}$ satisfy eq. 7 below:

$$C_j = 2^{j-1} C1, \; 1 \leq j \leq n \qquad \text{eq. 7}$$

Herein, the capacitance between the common terminal O of the switch $SW_{00}$ and the output terminal Y (which functions as an external connection point of the programmable capacitor array $PCA_1$ to $PCA_p$) can be expressed by eq. 8 below:

$$C(b^i) = \sum_{j=1}^{n} 2^{j-1} b_j^i C_1 \qquad \text{eq. 8}$$

where $b_0^i$ takes either value of 0 or 1.

Figure 4:
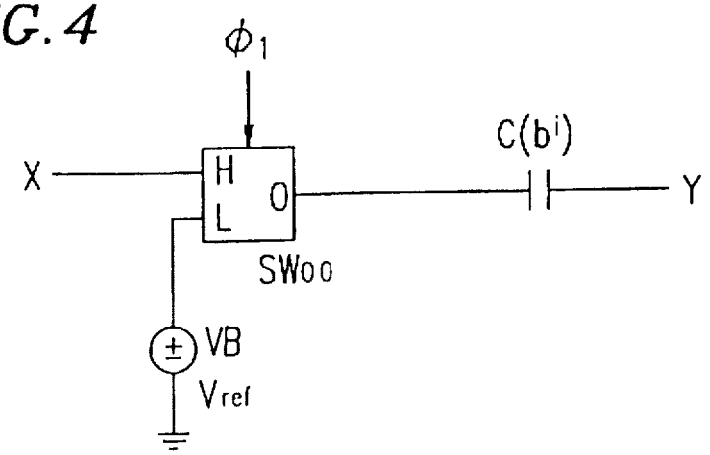
FIG. 4 is an equivalent circuit diagram showing the state of a programmable capacitor array $PCA_i$ in FIG. 2 when $b_0^i$="0".

Accordingly, when the binary value $b_0^i$ is "0", the programmable capacitor array circuit becomes equivalent to the circuit shown in FIG. 4, thus forming a capacitance corresponding to the positive elements of the coefficient vector. The positive elements can include zero.

Figure 5:
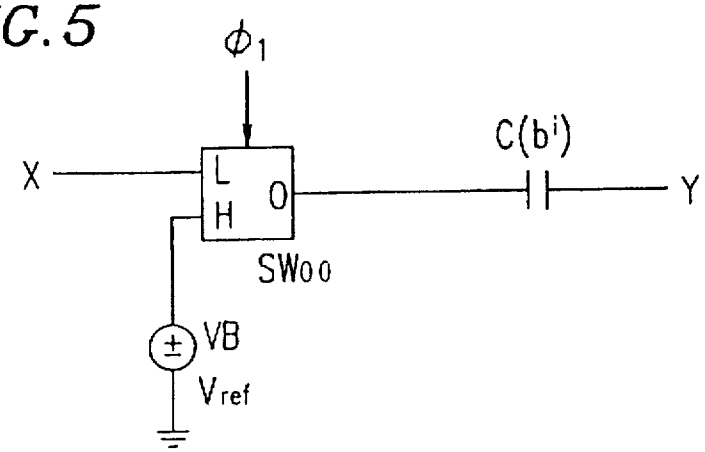
FIG. 5 is an equivalent circuit diagram showing the state of a programmable capacitor array $PCA_i$ in FIG. 2 when $b_0^i$="1".
Figure 6:
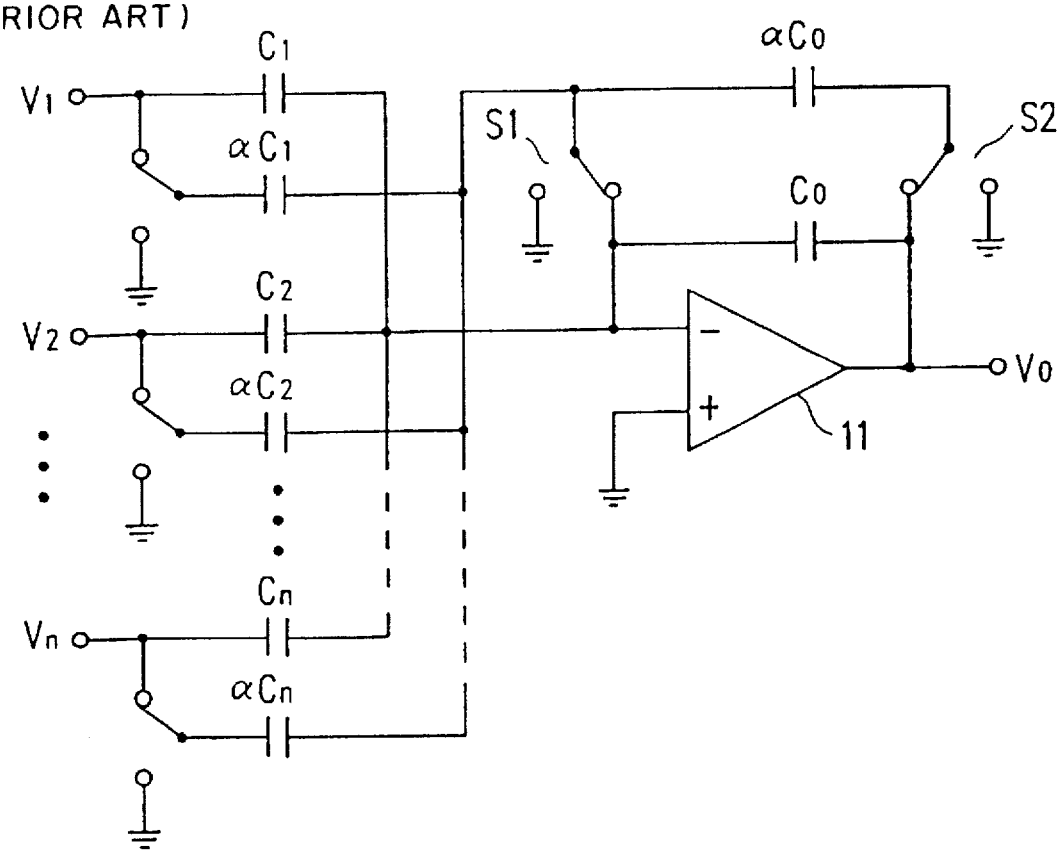
FIG. 6 (PRIOR ART)
FIG. 6 is a circuit diagram showing a conventional inner product calculation device.

Accordingly, when the binary value $b_0^i$ is "1", the programmable capacitor array circuit becomes equivalent to the circuit shown in FIG. 5, thus forming a capacitance corresponding to the negative elements of the coefficient vector. The negative elements can include zero.

As in the operation of Example 1, the value (output voltage $V_O$ of the operational amplifier 31—reference voltage Vref) obtained during effective portions of each cycle converges at a value represented by eq. 9 below:

$$V_o - V_{ref} = -\frac{\sum_{i=1}^{m} (-1)^{b_o^i} C(b^i)(Vi - V_{ref})}{C_o} \qquad \text{eq. 9}$$

Thus, the input offset voltage Voffset of the operational amplifier 31 is cancelled in the present example, as well as in Example 1. The inner product calculation device of the present example thus calculates an inner product, as in Example 1.

In accordance with the inner product calculation device of the present invention, input voltages for which an inner product with negative elements of the coefficient vector is to be calculated are applied to one group of capacitors when the operational amplifier is in a follower coupling state; input voltages for which an inner product with positive elements of the coefficient vector is to be calculated are applied to another group of capacitors when the operational amplifier is in an inversion amplification coupling state. The positive elements can include zero; the negative elements can include zero. Thus, the inner product calculation device is capable of calculating an inner product of a coefficient vector and an input voltage vector even in the case where the coefficient vector includes both positive elements and negative elements. In the case where the dimension of the input voltage vector is n, the coefficient vector can be an n-dimension coefficient vector consisting of n coefficients which have analog or digital values with signs of plus or minus.

In accordance with the inner product calculation device of the present invention, the input offset voltage of the operational amplifier is cancelled. As a result, the accuracy of inner product calculation improves.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An inner product calculation device for calculating an inner product of a coefficient vector including at least one first element with a positive sign and at least one second element with a negative sign and an input vector including elements corresponding to a plurality of input voltages, the device comprising:

an amplifier having an input terminal and an output terminal;

at least one first capacitor corresponding to the at least one first element with the positive sign, the first capacitor including one end, another end, and a capacitance which is in proportion to a value of the at least one first element;

at least one second capacitor corresponding to the at least one second element with the negative sign, the second capacitor including one end, another end, and a capacitance which is in proportion to an absolute value of the second element;

a third capacitor having one end and another end, the one end of the third capacitor being connected to the one end of the first capacitor, the one end of the second capacitor, and the input terminal of the amplifier;

a voltage source for:

(a) applying, during a first period, a corresponding one of the plurality of input voltages to the other end of each of the at least one first capacitor and a reference voltage to the other end of the at least one second capacitor and the other end of the third capacitor; and (b) applying, during a second period following the first period, the reference voltage to the other end of the first capacitor, a corresponding one of the plurality of input voltages to the other end of each of the at least one second capacitor, and an output voltage output from the output terminal of the amplifier to the other end of the third capacitor; and a switch for short-circuiting the input terminal of the amplifier and the output terminal of the amplifier during a third period.

2. A inner product calculation device according to claim 1, wherein each of the at least one first capacitor receives a binary signal for changing the capacitance of the first capacitor, and each of the at least one second capacitor receives a binary signal for changing the capacitance of the second capacitor.

3. An inner product calculation device according to claim 1, wherein the first period is longer than the third period.

4. An inner product calculation device according to claim 1, wherein the amplifier is an operational amplifier.

5. An inner product calculation device according to claim 1, wherein the amplifier includes at least one invertor.

6. An inner product calculation device according to claim 1, wherein the plurality of input voltages consist of a set consisting of those input voltages which correspond to the other end of the at least one first capacitor and a set consisting of those input voltages which correspond to the other end of the at least one second capacitor.

* * * * *